United States Patent [19]

Tanaka

[11] 3,932,251

[45] Jan. 13, 1976

[54] METHOD FOR MANUFACTURING AN INK-CONTAINABLE STAMP

[76] Inventor: Tomoji Tanaka, No. 19-8, Takarayama-cho, Toyonaka, Osaka, Japan

[22] Filed: May 16, 1974

[21] Appl. No.: 470,494

[52] U.S. Cl. ..... 156/245; 101/382 R; 101/383; 101/401.1; 101/401.2; 101/401.3; 156/272; 156/293; 264/250

[51] Int. Cl.[2] ..... B41C 3/00; B41N 1/22

[58] Field of Search ..... 156/242, 245, 244, 277, 156/272, 293; 101/401.1, 401.2, 401.3, 382 R, 383; 264/220, 250

[56] References Cited

UNITED STATES PATENTS

| | | | |
|---|---|---|---|
| 3,002,858 | 10/1961 | Newman et al. | 156/242 |
| 3,141,407 | 7/1964 | Leeds | 101/401.1 |
| 3,260,779 | 7/1966 | Tarbox | 101/401.1 |
| 3,387,074 | 6/1968 | Hill | 156/245 |

*Primary Examiner*—Caleb Weston

*Attorney, Agent, or Firm*—Jones, Tullar & Cooper

[57] ABSTRACT

A method for manufacturing an ink-containable stamp used for a printer of a computer or the like is disclosed, wherein a number of printing types and a drum or plate are moulded from a mixture comprising synthetic resin consisting of polyvinyl acetate resin and polyolefin resin, fillers, stabilizers, plasticizers and pigments, irradiated with gamma-rays, immersed in an enzymatic solution and then in an acid solution. The type and drum or plate are then assembled to form a printing element.

7 Claims, 6 Drawing Figures

METHOD FOR MANUFACTURING AN INK-CONTAINABLE STAMP

The present invention relates to a method for manufacturing an ink-containable stamp used for a printer of a computer or a typewriter, and more particularly, to a method for manufacturing an ink-containable stamp capable of printing on paper without use of carbon tape.

In recent years, there has been used an ink-containable stamp comprising a number of printing types and a drum or plate for the purpose of printing on paper without use of carbon tape. Hitherto, such ink-containable stamps have been manufactured by a method which comprises mixing polyvinyl resin with fillers (e.g. sodium chloride ammonium sulfate, aluminium sulfate, starch), stabilizers, pigments, plasticizers and ethlylene glycol, molding a drum, hardening the drum by heating after stamping, immersing it in the boiling water to eliminate the soluble components. Another method comprises mixing synthetic rubber with fillers, vulcanizing agents, stabilizers and solvents, heating the mixture, molding a drum with a mold and immersing the drum stamped by the mold in the boiling water.

In these ink-containable stamps, however, there have been many problems awaiting solution. For example, the ink content of the ink-containable stamps is small, being limited to a range of 1.0 to 1.7 g of ink per unit weight of the stamp, so that it is impossible to use these stamps a number of times, corresponding to the life of carbon tapes. It is also necessary to avoid use of oil ink since the materials for such stamps are soluble in or weakened by organic solvents. Further, such stamps are not durable and have the tendency to change shape as they are poor in hardness, durability and chemical resistance.

It has also been found that the fillers dissolve in solvents such as glycols at an elevated temperature and adhere to the surface of the molecules of the synthetic resin, interfering with the plastization of the synthetic resin. In order to avoid such phenomenon, it is necessary to elevate the treating temperature more than about 180°C. However, if the temperature is raised up to about 200°C or above, the synthetic resin may decompose, causing deterioration of the quality of the stamps. If the temperature is below 180°C, the synthetic resin may become a half-boiled state causing the deterioration of the quality of the stamps. It is therefore necessary to select the fillers and solvents with care.

It is a main object of the present invention to provide an improved method for manufacturing an ink-containable stamp capable of printing on paper without use of carbon tape.

According to the present invention, there is provided a method for manufacturing an ink-containable stamp used for a printer of a computer or a typewriter, which comprises the steps of:

a. mixing synthetic resin consisting of polyvinyl acetate resin and polyolefin resin with fillers, stabilizers, plasticizers, pigments and solvent;

b. molding a number of printing types and a drum or plate from the resultant mixture;

c. irradiating the printing types and the drum or plate with gamma rays;

d. immersing the printing types and the drum or plate in an enzymatic solution and then in an acid solution; and e. installing the printing types in concave portions of the drum or plate by the use of a binder.

As to synthetic resin used as materials for the present stamp, it is preferred to use a mixture of polyvinyl acetate resin and polyolefin resin since said mixture has the low melting point and high resistance to chemicals. The chemical resistance of this mixture may be increased in proportion to the increase of the amount of polyolefin resin so that the proportion of polyolefin resin in the mixture is preferably more than 40 % by weight and not more than 90 % by weight.

As polyolefin resin, it is preferred to use polyethylene resin having average molecular weights of about 2,000 to 50,000 or polypropylene resins having average molecular weight of about 5,000 to 100,000.

As polyvinyl acetate resin, it is preferred to use resins as having average molecular weights of about 5,000 to 70,000.

For preventing the half-boiled state of the synthetic resin, it is preferred to use fillers such as, for example, calcium carbonate, manganese carbonate, precipitated calcium carbonate, zinc carbonate, zinc hydroxides, etc., which are insoluble in glycols such as ethylene glycol, propylene glycol, etc. It is also preferred to use such fillers as having particle sizes from $0.1\mu$ to $8\mu$. By using such fillers mentioned above, it is possible to obtain an uniform porous state on the stamp. Further, it is also possible to prevent the deterioration of the modulus of elasticity of the resin even if the amount of the fillers is greater than that of the resin.

After treated with an enzymatic solution, the printing types and the drum or plate are immersed in an acid solution such as a solution containing a urea complex such as, for example, $(CO_2)(NH_2)_2HCl$, $(CO_2)(NH_2)_2.HNO_3$, $(CO_2)(NH_2)_2H_2SO_4$, etc., or organic acid for effecting decalcium and/or demagnecium. By effecting decalcium and/or demagnesium, that is extracting the fillers from the resin, the printing types and the drum or plate become uniformly porous. However, the decalcium and/or demagnesium may result in a lowering of durability and abrasion resistance of the printing types and the drum or plate. The above problem may be overcome by irradiating with gamma-rays before effecting decalcium and/or demagnesium. By this treatment, the melting point of the materials may be elevated from 70° – 80°C to 180°C or above, and the hardness and the chemical resistance thereof may be improved. Thus, the printing types and the drum or plate may be improved in the durability.

According to the present invention, it is possible to improve the ink content of the stamp up to about 2.8 g per unit weight. When using the ink-containable stamp according to the present invention, it is possible to print for about 80,000 to 100,000 times per one charge of the ink. Further, this ink-containable stamp may be used repeatedly by charging with ink since it has high durability.

The invention will be further apparent from the following description with reference to examples and the several figures of the accomponying drawings.

Figure 1:
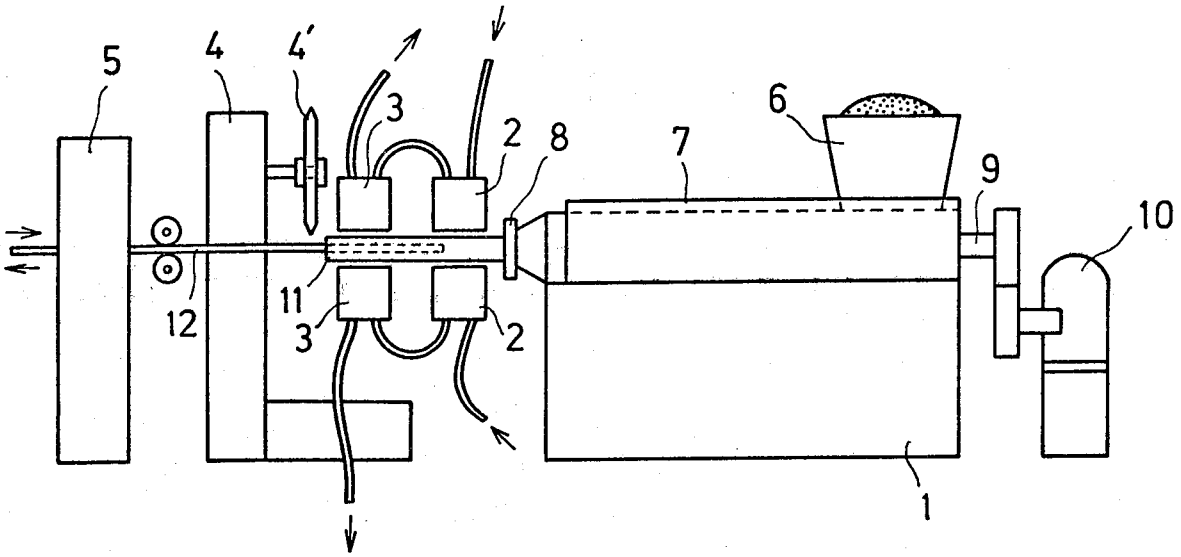
FIG. 1 is a side view showing an outline of an apparatus for use in this invention.
Figure 2:
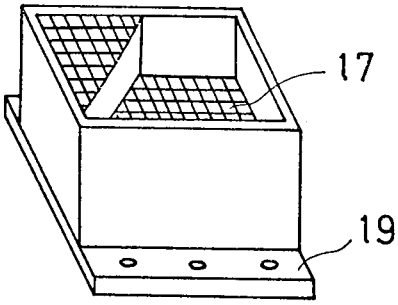
FIG. 2 is a perspective view of a mold for producing printing types.
Figure 3:
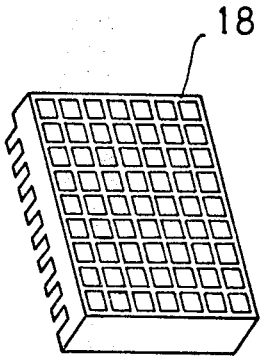
FIG. 3 is a perspective view of a printing type.
Figure 4:
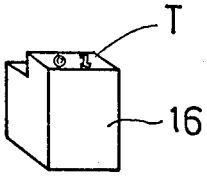
FIG. 4 is a perspective view of a frame to be installed on the mold in FIG. 2.

Referring to FIG. 1, the apparatus used for this invention includes an extruder 1 of a known type, a die press 2, a heat exchanger 3, a cutting machine 4 and an auxiliary device 5. The extruder 1 comprises a hopper 6, an extruder barrel 7, an extruder die 8 and a screw conveyer 9 adapted to be driven by the extruder drive comprising an electric motor 10.

EXAMPLE 1

Using materials shown below, a composition is prepared and kneaded uniformly by the kneader (not shown).

| | |
|---|---|
| A mixture of 60 % polyethylene and 40 % polyvinyl acetate | 100 parts by weight |
| Stabilizer (minium) | 3 parts by weight |
| Precipitated calcium carbonate (0.1 – 8$\mu$) | 250 parts by weight |
| Propylene glycol | 120 parts by weight |
| Active oil carbon | 5 parts by weight |
| Cyclohexane | 70 parts by weight |

Figure 5:
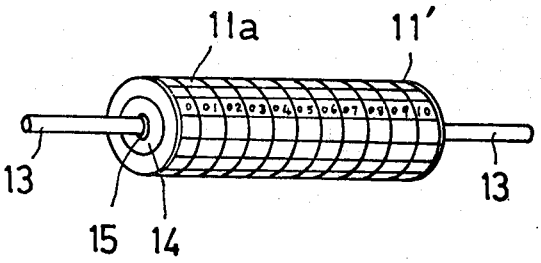
FIG. 5 is a perspective view of type drum.

The above mixture is fed to the hopper 6 and is conveyed toward the extruder die 8 by the screw conveyer 9. During this step, the mixture is heated to the melting point of the resin by the heat from the extruder barrel 7, the temperature of which is kept at about 150°to 180°C. The melted mixture is extruded through the die 8 to form a cylindrical body 11. This cylindrical body 11 is stamped by the die press 2 to form a number of concave portions aligned regularly as shown in FIG. 5, and is cooled at the same time. To prevent the cylindrical body 11 from deformation at the time of stamping step, there is inserted into the hole portion of the cylindrical body a rod 12, capable of reciprocating motion. After being cooled by the heat exchanger 3, the cylindrical body 11 is cut by a cutting wheel 4′ of the cutting machine 4 into a suitable length. In the hole of a drum 11′ thus produced, a plastic or metal axle 13 is inserted and is fastened with a washer 14 and a bolt 15 on each side of the drum as shown in FIG. 5.

Further, the mixture mentioned above is injected into an injection mold to form a number of printing types 16 through the opening of cover of the injection mold. The injection mold may be assembled in such a manner that a stamping die 17, a divisional frame 18 and a cover (not shown) are placed on the injection die 19 and then fastended together with bolts. After cooling, the printing types 16 are released from the injection mold in a known manner.

The drum 11′ and the printing types 16 are irradiated for about 15 to 20 minutes with gamma-rays of $10^4$ roentgen radiated by the isotope of cobalt-60. By this treatment, the drum 11′ and the printing types 16 are improved in mechanical properties such as compressive strength, hardness, durability, etc. and physical properties. For example, the compressive strength of the drum is improved from 2–4 kg/cm$^2$ to 20–35 kg/cm$^2$ when the radial thickness of the drum is 1 to 2 mm. If necessary, the compressive strength may be controlled by changing the content of active oil carbon powder and/or glycol borate.

After irradiation of gamma-rays, the drum 11′ and the printing types 16 are immersed in an aqueous solution containing 0.3 to 1.0 million units of pepsin for about 4 to 22 hours at a temperature of 30° to 50°C, and then immersed in the mixed solution consisting of 50 % urea and 50 % hydrochloric acid for about 20 to 900 hours. A porous state is uniformly obtained without deterioration of the mechanical and physical properties.

The printing types 16 thus obtained are washed, dried and then installed into the concave portions 11*a* of the drum 11′ respectively with a binder consisting of polyvinyl acetate resin and ethylene glycol in such a manner that the surface T of the printing type 16 faces to the outside. The mixture of triol and cyclohexane may be used with the finder mixture.

Figure 6:
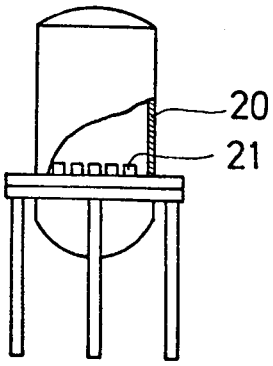
FIG. 6 is a side of the high-pressure tank used for charging the ink into the porous portion of the printing types and the drum.

The porous portion of an ink-containable stamp thus assembled may be charged with ink when immersed in ink under reduced pressure. When effecting the charge of ink, it is possible to use a device as shown in FIG. 6 wherein the said device comprised a high-pressure tank 20 provided with a rotary fan. The tank 20 may house several vessels containing ink respectively and the pressure in the tank may be reduced by operating the rotary fan. This ink-containable stamp may contain ink up to about 2.8 g per unit weight when the radial thickness thereof is 10 mm. Using this ink-containable stamp, it is possible to print on paper for about one million times at the maximum.

The following examples illustrate further formulations of compositions used for the ink-containable stamp according to the invention. These examples should not be construed as the limitations of the scope of the invention.

EXAMPLE 2

| Composition (parts and % are by weight): | |
|---|---|
| A mixture of 60 % polypropylene resin and 40 % polyvinyl acetate resin | 100 parts |
| Precipitated calcium carbonate (0.1 – 8$\mu$) | 200 parts |
| Calcium carbonate (0.1 – 8$\mu$) | 50 parts |
| Propylene glycol | 100 parts |
| Propylene glycol ether | 30 parts |
| Polybutyl titanate | 0.01 parts |
| Tung oil | 5 parts |
| Acidic aniline red | 2 parts |
| Trisacetylacetonatoiron (II) | 10 parts |
| Stabilizer (minium) | 6 parts |

EXAMPLE 3

| Composition: | |
|---|---|
| A mixture of 70 % polyethylene resin and 30 % polyvinyl acetate resin | 100 parts |
| A mixture of 50 % triol and 50 % cyclohexane | 300 parts |
| Magnesium carbonate | 200 parts |
| Polyethylene glycol | 100 parts |
| Glycerin | 10 parts |
| Organo-metallic compounds (Trisacetylacetonatoiron (III) : Bisacetylacetonatozinc : Trisacetylacetonatoaluminium = 1 : 1 : 1) | 0.1 parts |
| Active oil carbon or glycol borate | 0.1 parts |
| Cyclohexanon or tetrahydrofuran | 30 parts |

EXAMPLE 4

| Composition: | |
|---|---|
| Polyethylene | 50 parts |
| A mixture of 60 % polyvinyl chloride and 40 % polyvinyl acetate | 50 parts |
| Cyclohexanon | 200 parts |
| Dipropylene glycol | 160 parts |
| Cyclohexanol | 30 parts |
| Diol | 65 parts |

-continued

| | |
|---|---|
| Acidic aniline red | 3 parts |
| Trisacetylacetonatoiron (III) | 7 parts |
| Soy bean oil | 8 parts |
| Dioctylphthalate | 30 parts |
| Biscyclopentadienylcobalt (II) | 0.3 parts |
| Minium | 5 parts |
| Viscose rayon (below 14$\mu$), glass fiber ($1\mu - 8\mu$) or active silicic acid powder | 10 parts |

In Example 4, the porous state of the printing stamps and the drum is made by immersing them in alcohol.

What is claimed is:

1. A method for manufacturing an ink-containable stamp which comprises the steps of:

a. forming a mixture of synthetic resins comprising a mixture of polyvinyl acetate and polyolefin resin containing 40 to 90% polyolefin resin, with one or more fillers insoluble in glycols and extractable from the resin by the use of an acid solution containing an urea complex or an organic acid, stabilizers, pigments and solvents;

b. separately molding a number of printing types, and a drum or plate having a number of concave portions from said mixture;

c. irradiating the printing types and the drum or plate with gamma-rays;

d. immersing the printing types and the drum or plate in a pepsin solution and then in an acid solution thereby extracting the fillers to form porosity in the printing types and the drum or plate;

e. installing the printing types in the concave portions of the drum or plate by the use of a binder.

2. A method, as in claim 1, where the filler is selected from the group consisting of calcium carbonate, manganese carbonate, zinc carbonate and zinc hydroxide.

3. A method, as in claim 2, where the filler has a particle size of from $0.1\mu$ to $8\mu$.

4. A method, as in claim 1, where the acid solution is a solution containing an urea complex or an organic acid.

5. A method, as in claim 1, where the polyolefin resin is polyethylene or polypropylene.

6. A method, as in claim 1, where the synthetic resin mixture consists of polyvinyl acetate and polypropylene, the weight ratio of polypropylene to polyvinyl being more than 40%.

7. A method, as in claim 1, where the acid solution is a solution containing urea and hydrochloric acid, and the synthetic resin mixture consists of polyvinyl acetate and polyethylene, the weight ratio of polypropylene to polyvinyl acetate being more than 40%.

* * * * *